United States Patent [19]

Bonalumi

[11] 4,258,639

[45] Mar. 31, 1981

[54] WORKPIECE ADVANCING APPARATUS FOR SEWING MACHINES

[75] Inventor: Pietro Bonalumi, Cernusco sul Naviglio, Italy

[73] Assignee: Rockwell-Rimoldi, S.p.A., Milan, Italy

[21] Appl. No.: 32,134

[22] Filed: Apr. 23, 1979

[30] Foreign Application Priority Data

May 17, 1978 [IT] Italy ..... 23484 A/78

[51] Int. Cl.[3] ..... D05B 27/12

[52] U.S. Cl. ..... 112/322; 112/18; 226/193

[58] Field of Search ..... 112/18, 322, 318, 308, 112/304, 14, 47, 83, 30, 267.1, 121.15; 226/87, 181, 193; 271/19, 21, 109; 19/258

[56] References Cited

U.S. PATENT DOCUMENTS

| | | | |
|---|---|---|---|
| 520,208 | 5/1894 | Kohler | 112/18 |
| 1,841,858 | 1/1932 | Thobroe et al. | 112/322 |
| 2,509,491 | 5/1950 | Fox | 112/18 |
| 2,692,568 | 10/1954 | Galkin | 112/322 |
| 3,384,730 | 5/1968 | Easley | 226/193 X |
| 3,496,892 | 2/1970 | Marforio | 112/18 |

FOREIGN PATENT DOCUMENTS

| | | | |
|---|---|---|---|
| 583990 | 8/1933 | Fed. Rep. of Germany | 112/322 |

*Primary Examiner*—Werner H. Schroeder
*Assistant Examiner*—Andrew M. Falik

[57] ABSTRACT

A device for supporting and guiding a folded workpiece to the stitching needle of a sewing machine by advancing the same between a pair of cylindrical members mounted on the machine for rotation in opposite directions. Each of the cylindrical members is provided with circumferential grooves on their peripheral surfaces with the grooves of each being in general alignment with those of the other. The configuration of the grooves in combination with the spacing between the cylindrical members causes the folded workpiece being advanced therebetween, to become deformed to the extent where portions thereof enter the grooves to effectively support its weight while accurately guiding it along the level of its intended path of travel.

2 Claims, 4 Drawing Figures

WORKPIECE ADVANCING APPARATUS FOR SEWING MACHINES

BACKGROUND OF THE INVENTION

The present invention pertains to improved counter-rotating cylindrical members that are utilized on sewing machines for advancing a workpiece to the stitching instrumentalities of the machine so that a covering or safety overlock stitch may be formed along the line which joins or bonds together two faced portions of material forming said workpiece.

As is well known to those conversant in the art, machines which are adapted to form the type stitching mentioned above, the workpiece is caused to advance by the action of the counter-rotating cylindrical members and the space between said cylindrical members is such that a force is applied to the workpiece which assists in supporting it as it is being advanced.

When the sewing machines are used in a particular way, such for example, as forming a covering or safety stitch that is of substantial width or of the type which does not pass through the thickness of a spongy or extrememly elastic material that forms the facing material which is also of substantial thickness, the known forms of counter-rotating cylindrical members have not performed their intended function with complete satisfaction. This can be attributed to the fact that to apply a sufficient force to this type of workpiece, the counter-rotating cylindrical members must be located in positions of relatively close proximity which limits the thickness of the fold in the workpiece where the stitching is to be formed which consequently limits the width of the seam superimposed along the line which joins or bonds the pieces of material together that form the workpiece.

When the material forming the workpiece is that utilized in the fabrication of divers' suits, it is known that this material is of the closed cell type, i.e. it contains within its thickness substantially spherical shaped voids, which are mutually insulated and densely distributed in the mass of the material, and do not communicate with the exterior surface thereof. Usually this material is covered on one side with a synthetic fabric, which is generally nylon, so as to avoid direct contact with the human body. When fabricating these suits, it is common practice to unite the component parts together by means of bonding using a suitable adhesive or the like, as well as a reinforcing seam so as to maintain the garment in an impermeable condition.

The seam along the line of bonding, however, serves the purpose of providing reinforcement and preventing tearing apart and breakdown of the fabric structure.

In other words, the reinforcing seam should only cover the surface region of the bond.

The material for workpieces of the type described has a thickness which can vary from a minimum of 2.5 millimeters for certain lightweight diving suits up to more than 9 mm. for heavier suits. During incorporation of the seam, the workpiece is folded along the line of the bond with the folded portion being disposed between and advanced by the counter-rotating cylindrical members. In the case of material of substantial thickness, it is possible for the edge of the internal portion of the fold to be located relatively close to the base or lower edge of the cylindrical members and in combination with the deformation of the material there is a natural tendency for the workpiece to work itself out from between said cylindrical members. Additionally with the material of the workpiece having a substantial amount of elasticity and being subjected to the holding forces of the cylindrical members, the tendency of the workpiece to work free of said cylindrical members is greatly accentuated.

When forming such seams, the operator, in addition to guiding the material so that the line of bond will be centered in the stitching, must also support the material by holding it against the upper limiting guide which controls the depth of the stitching, i.e. the distance penetrated by the needle into the material from the external surface of the fabric.

The present known art consequently suffers from disadvantages which derive from the limitation of the internal folding of a workpiece which is necessary in order to avoid the tendency of said workpiece from dislodging itself from between the cylindrical members. The difficulties had during this operational procedure are due to the amount of force required for guiding this particular type of material, the limitations relative to the folded thickness of the material, as well as the width of seam obtainable and are very definitely related one to the other.

The present invention has corrected the disadvantages described above by providing a means which is capable of supporting the workpiece with a minimum of effort while it is being advanced between the counter-rotating cylindrical members which exert a minimum amount of force on the fold so as to form a desirable width of seam on the surface of the workpiece that is fabricated from a substantially elastic material.

SUMMARY OF THE INVENTION

The improved counter-rotating cylindrical members of the present invention are provided with means on their peripheral surfaces which are capable of supporting the weight of the workpiece and for guiding the same along the sewing axis in a positive manner and with the advantage of being able to incorporate a seam of any desirable and predetermined width.

In accordance with a preferred embodiment of the invention this means defines a plurality of circumferential grooves disposed in spaced and parallel relation in each of the counter-rotating cylindrical members. The grooves in one cylindrical member are in general alignment with the grooves of the other and as the folded workpiece is caused to pass therebetween the highly elastic material from which it is fabricated is caused to be deformed to the extent where portions thereof enter said grooves and is effective in adequately guiding and supporting the weight of said workpiece.

Other corresponding means, such as for example the frusto-conical shaping of the external surfaces of the cylindrical members, could with advantage be utilized in those cases in which the thicknesses of the material to be sewn do not have substantial variations between themselves.

Further characteristics and advantages of the invention will become more fully apparent by reference to the appended claims and as the following detailed description proceeds in reference to the figures of drawing wherein:

DESCRIPTION OF THE PREFERRED EMBODIMENT

Figure 1:
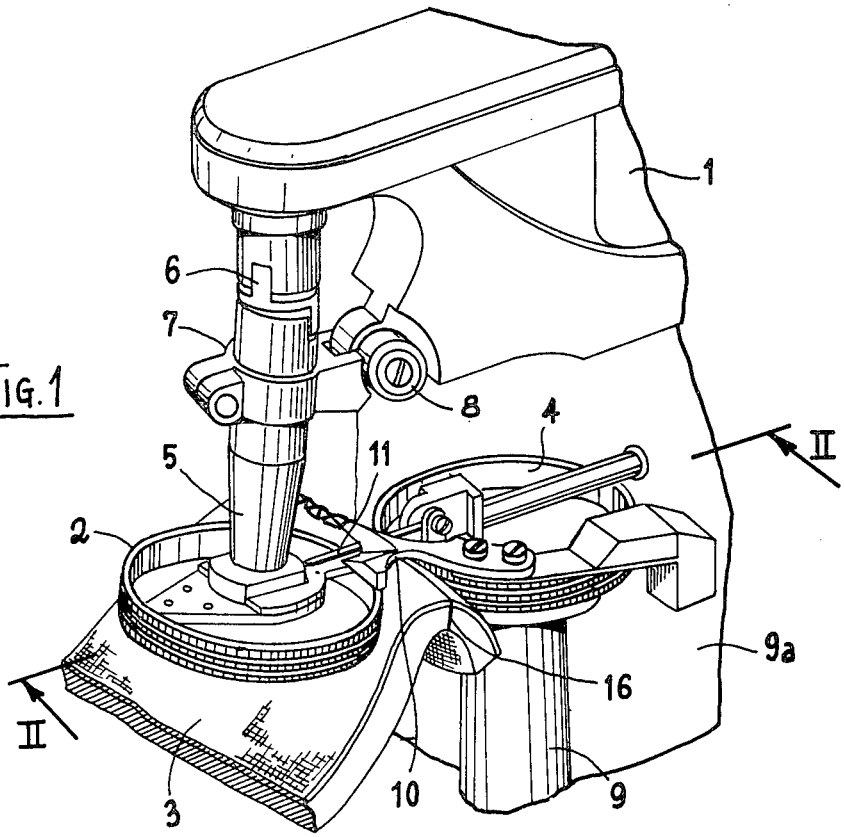
FIG. 1 is a perspective view of a portion of a sewing machine showing the improved counter-rotating cylindrical members of the invention applied thereto.
Figure 3:
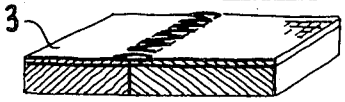
FIG. 3 is a perspective view and partially in section showing a seam of covering or safety overlock stitches applied to a workpiece.

Referring to the drawing wherein only as much of a sewing machine, to which the invention is applicable, is depicted as is necessary to a complete understanding of the invention, there is shown in FIG. 1 a projecting frame 1 on which an outer cylindrical member 2 is rotatably mounted. This outer cylindrical member 2 performs a dual function of pulling material 3 to be sewn and pressing the same into engagement with the peripheral surface of an inner counter-rotating cylindrical member identified by numeral 4. The outer cylindrical member 2 is rotatably mounted on the lower end of a depending arm 5 which includes a conventional connecting joint 6 intermediate its ends and a ring 7 which is connected to the frame by means of a pivot 8. The arrangement of these elements is such that the cylindrical member 2 can rotate not only in the horizontal plane but also on planes which are slightly inclined, and thus provide for its correct positioning with respect to the inner cylindrical member 4 relative to the thickness of the material to be sewn.

The inner cylindrical member is rotatably mounted on a fixed arm 9 which is vertically disposed on a mounting member 9*a* of frame 1, so that rotation of said member is always in a horizontal plane. The combination of the two movements of the counter-rotating cylindrical members wherein one is disposed in a plane which does not deviate from the horizontal, and the other in a plane that is more or less inclined, allows for regulation of the amount of force that is applied to the workpiece.

Figure 2:
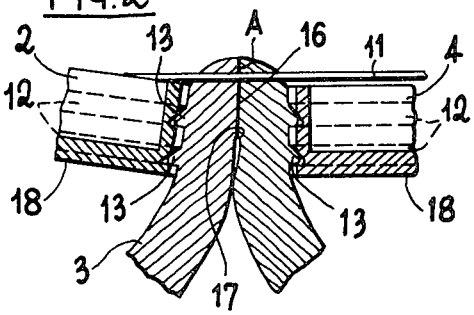
FIG. 2 is a sectional view taken along Line II—II in FIG. 1 showing that portion of the cylindrical members which engage the workpiece.

A common type of upper limiting guide 10 is located above the inner cylindrical member 4 and being disposed parallel to the line of stitching, establishes the so-called depth of penetration of the needle 11 into the material relative to is external portion as shown in FIG. 2. Normally the peripheral surface of counter-rotating cylindrical members have a vertical oriented knurling or toothing which serves to facilitate the advance of the workpiece to the stitching instrumentalities. The improved counter-rotating cylindrical members of the invention which are effective in supporting the weight of the workpiece are provided with circumferential grooves 12 in each of said cylindrical members (FIGS. 2 and 4) which are disposed in spaced and parallel relation relative to one another and with the grooves of one member being in general alignment with those of the other.

As shown in FIG. 2, the highly elastic material forming the workpiece becomes deformed as it is advanced between the cylindrical members 2 and 4 so that portions thereof are caused to enter into the grooves 12 in the form of bulbous elements or protrusions 13. These protrusions 13 provide a supporting vector that is directed upwardly and which opposes the weight of material to be sewn in an efficacious manner.

Figure 4:
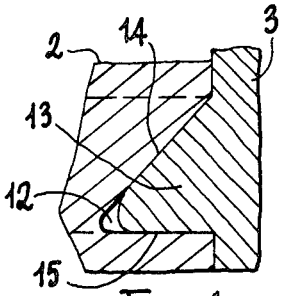
FIG. 4 is a sectional view on an enlarged scale of a portion of the peripheral surface of a cylindrical member showing the manner in which a workpiece is adapted to engage the grooves thereof.

As shown in FIG. 4, the preferred configuration of the grooves 12 is substantially in the form of a right-angled triangle which is open and with the hypotenuse 14 thereof being directed upwardly and toward the inside of the contact area of the other cylindrical member. The base portion of this triangular configuration is identified by numeral 15 and provides a supporting surface which extends in a plane orthogonal to the peripheral surface of the cylindrical member. This form of parallelism of the base portion 15 and grooves 12 is effective in providing the maximum supporting action on the workpiece by means of the contact that is had between the protrusions 13 and said grooves. The grooves 12 are identically disposed in each cylindrical member so that they will be in alignment one with the other during the performance of their intended function. This alignment of the grooves of one cylindrical member with those of the other avoids any winding action or force on the workpiece which apart from incorporation of an undesirable seam would cause said workpiece to become dislodged from between said cylindrical members.

In FIG. 2 the workpiece is shown in cross-section and being folded as at 16 along the line of bond of the highly elastic material, it can be readily understood that with greater thicknesses of such material the lower internal portion of the fold, which is depicted by numeral 17, would be located substantially close to the base portion 18 of the cylindrical members. Under such conditions and with the known forms of counter-rotating cylindrical members the deformation which is introduced into the highly elastic material acts to continuously urge the workpiece outwardly from between said cylindrical members. Additionally this tendency for the workpiece to be pushed out from between the cylindrical members is further accentuated in the areas where it enters and exits from between said members due to the fact that the fold is considerably wider at these locations than it is in the area of contact by said cylindrical members.

The grooves forming the improved counter-rotating cylindrical members according to the invention provide the advantage, even with very thick material, of causing portions of said material to enter the grooves 12 so as to form protrusions 13 that satisfactorily support the weight of the workpiece on the base portion 15 of said grooves. These protrusions provide a wedging action between the cylindrical members that can be attributed more to the elasticity of the material than by the effect of the forces against the workpiece that is provided by said cylindrical members. Consequently, the normal forces provided by the cylindrical members can be substantially reduced which will permit a very definite increase in the width of fold of a workpiece which can satisfactorily pass between and be supported by said cylindrical members. A wider fold also provides the advantage of being able to incorporate a wider, uniform and secure seam because it includes a wide zone of material close to the bond through which the needle is adapted to pass. The protrusions 13 also eliminate the former need of an operator maintaining the workpiece properly elevated by pushing it upwardly during stitching and which was frequently responsible for forming a seam of non-uniform width due to the fact that such manual intervening cannot be accurately controlled for such a method continuously varies the distance between the stitching area and the area where the pushing force is applied. Additionally when incorporating a covering or safety overlock stitching on thinner material, the possibility of sewing over a wide fold and consequently onto material which is not highly compressed which maintains its true thickness along the entire arc of the fold, offers the advantage that it is possible to sew quickly and with extreme safety in the required manner, without the need of pushing the lower end of the bond upwardly and consequently producing a seam which passes completely through the material.

A sewing machine provided with the improved counter-rotating plates according to the invention, may, as a result of what has been heretofore described, be utilized in the assembly stitching operation of knitted fabrics which in addition to the substantial thickness of the pieces to be assembled, they are fabricated from a soft and resilient material similar to the highly elastic workpieces described above.

The particular configuration of the circumferential grooves 12 provides a very desirable feature in that they do not vary in the effect they have on different workpieces which require a different spacing between the cylindrical members. Other configurations, such for example, as frusto-conical shaping of the peripheral surfaces of the cylindrical members could be utilized, but bearing in mind that their supporting action on a workpiece will vary when the distance between the cylindrical members is increased or decreased. In the case of relatively thin workpieces, the closeness of the cylindrical members forms an area therebetween into which the fold of the workpiece is inserted and which has a cross-section that narrows, in a known manner, towards the bottom thus providing a desired upward pushing force which is sufficient to support the material to be sewn. In the case of substantially thick workpieces the space between the cylindrical members is greater so that one thereof is inclined relative to the other causing their peripheral surfaces to be in positions whereat they exert a considerably less supporting influence on such workpieces than those of lesser thickness. For this reason cylindrical members having a frustro-conical configuration formed on their peripheral surfaces could be advantageously utilized because this particular shaping can be more economically provided; however, it should only be considered in those cases in which the thickness of the different materials to be sewn do not differ appreciably one from the other.

Although the present invention has been described in connection with a preferred embodiment, it is to be understood that modifications and variations may be resorted to without departing from the spirit and scope of the invention as those skilled in the art will readily understand.

Such modifications and variations are considered to be within the purview and scope of the invention and the appended claims.

I claim:

1. An improved device for advancing a folded workpiece to the stitching needle in a sewing machine of the type for applying a seam of safety overlock stitches along a line bonding two faced portions of elastic material forming the workpiece, the improvement comprising:

(a) a pair of spaced cylindrical members (2,4) mounted for rotation in opposite directions on the machine in operative association with the stitching needle for advancing the workpiece through the stitching zone;

(b) means formed on the peripheral surface of each said cylindrical members for guiding the workpiece as it is advanced therebetween and for supporting the weight thereof defining:

(i) spaced and parallel circumferential grooves (12) extending in a plane parallel to the direction of workpiece advancement in each of said cylindrical members for receiving portions of the workpiece deformed by the cylindrical members as it is advanced therebetween.

2. The improved device according to claim 1 wherein said circumferential grooves (12) have a cross-sectional configuration substantially that of an open right-angled triangle with the hypotenuse (14) thereof inclined upwardly and toward the other cylindrical member and with the base portion (15) extending in a plane orthogonal to the peripheral surface of said cylindrical members.

* * * * *